US006763530B2

(12) United States Patent
Lu et al.

(10) Patent No.: US 6,763,530 B2
(45) Date of Patent: Jul. 20, 2004

(54) AUTO-REVERSIBLE TOILET SEAT MOUNTING STRUCTURE

(76) Inventors: Shou Chi Lu, 1F, No. 462, Chung Hsiao E. Rd., Sec. 5, Taipei (TW); Shieh Neng Lu, 1F, No. 462, Chung Hsiao E. Rd., Sec. 5, Taipei (TW)

( * ) Notice: Subject to any disclaimer, the term of this patent is extended or adjusted under 35 U.S.C. 154(b) by 0 days.

(21) Appl. No.: 10/669,466

(22) Filed: Sep. 25, 2003

(65) Prior Publication Data

US 2004/0064877 A1 Apr. 8, 2004

(30) Foreign Application Priority Data

Oct. 4, 2002 (TW) ..... 91215766 U

(51) Int. Cl.[7] ..... A47K 13/10
(52) U.S. Cl. ..... 4/241; 4/246.1
(58) Field of Search ..... 4/241, 246.1

(56) References Cited

U.S. PATENT DOCUMENTS 5,138,724 A * 8/1992 Chien et al. ..... 4/241
5,435,017 A * 7/1995 Pan ..... 4/246.2
5,461,734 A * 10/1995 Faircloth ..... 4/246.1
6,470,502 B2 * 10/2002 Lu ..... 4/246.1

* cited by examiner

*Primary Examiner*—Gregory L. Huson
*Assistant Examiner*—Huyen Le

(57) ABSTRACT

An auto-reversible toilet seat mounting structure is constructed to pivotally fasten a toilet seat to a bracket at the rear side of a toilet bowl for enabling the toilet seat to be turned relative to the toilet bowl between a vertical position and a horizontal position and automatically returned to the vertical position by means of circulation of steel balls between two chambers in each coupling device after each use of the toilet by the user.

18 Claims, 9 Drawing Sheets

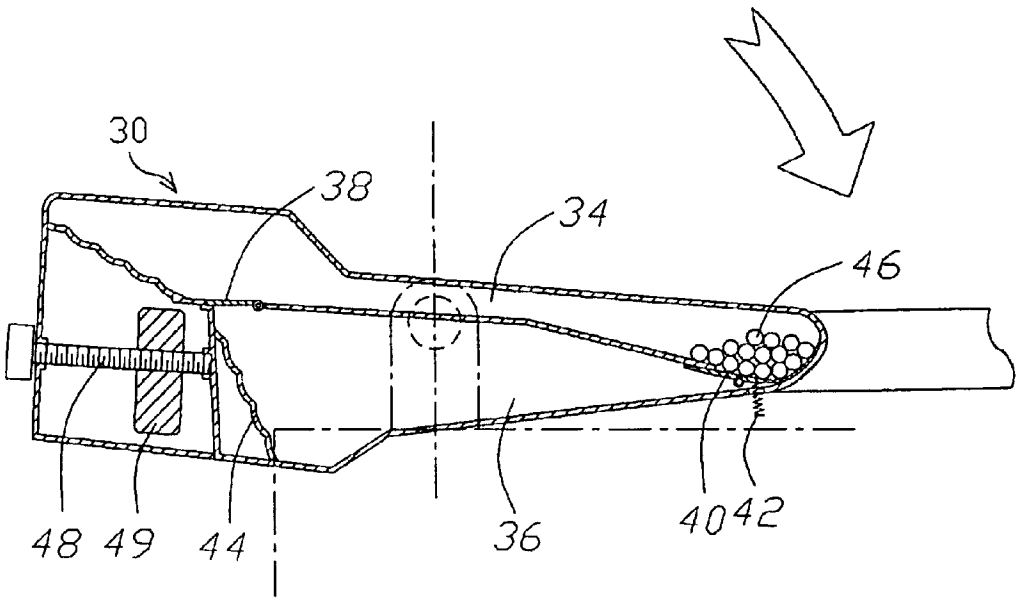
Fig. 4A
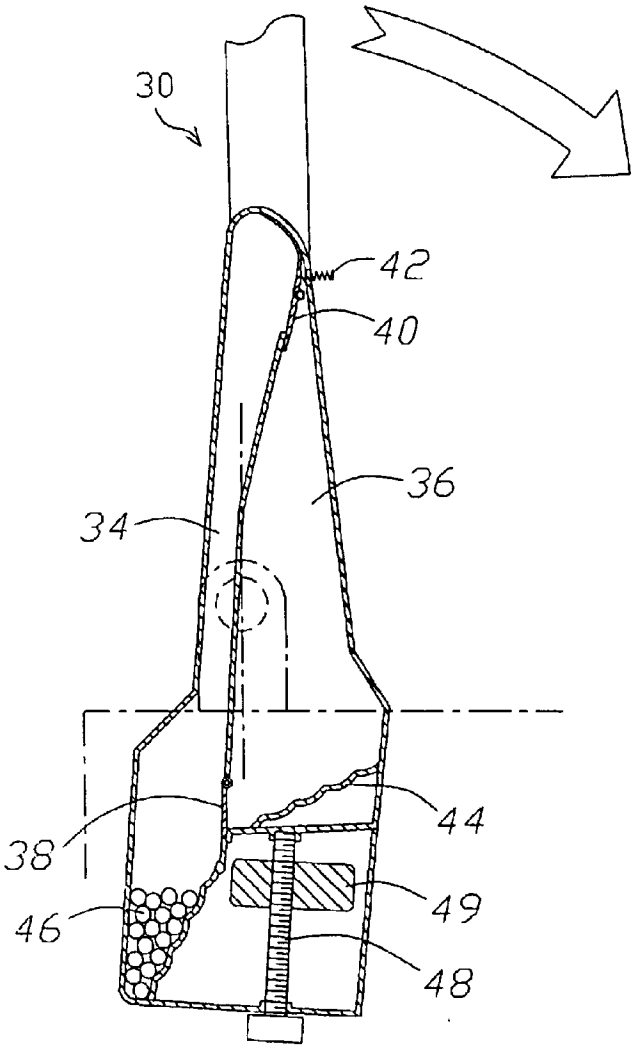

AUTO-REVERSIBLE TOILET SEAT MOUNTING STRUCTURE

BACKGROUND OF THE INVENTION

1. Field of the Invention

The present invention relates to a toilet seat and, more specifically, to an auto-reversible toilet seat mounting structure, which automatically smoothly lifts the toilet seat after each use of the toilet by a user.

2. Description of the Related Art

FIGS. 1A and 1B show a coupling device for use in an auto-reversible toilet seat mounting structure to pivotally fasten a toilet seat to a bracket at the rear side of a toilet bowl for enabling the toilet seat to be automatically returned to the vertical position after each use of the toilet by a user. The coupling device 10 is a hollow member having a front chamber 14, a rear chamber 16, a bottom chamber 18, a narrow passage 24 in fluid communication between the front chamber 14 and the rear chamber 16, a guide tube 22 connected between the rear chamber 16 and the bottom chamber 18, a throttle gate 24 set between the front chamber 14 and the bottom chamber 18, a counterweight block 22 disposed at the rear side to compensate the weight of the toilet seat. When in use, a fluid is filled in the coupling device 10. After each use of the toilet by a user, the fluid flows from the front side in each coupling device to the rear side, thereby causing the respective coupling device to lift the toilet seat. This structure of auto-reversible toilet seat mounting structure is not practical for use in the Frigid Zone because the fluid freezes when cold. Further, the coupling device tends to be damaged, causing the fluid to leak out and to contaminate the surroundings.

Therefore, it is desirable to provide an auto-reversible toilet seat mounting structure that eliminates the aforesaid drawbacks.

SUMMARY OF THE INVENTION

The present invention has been accomplished under the circumstances in view. It is therefore the main object of the present invention to provide an auto-reversible toilet seat mounting structure, which is free from the limitation of working temperature. It is another object of the present invention to provide an auto-reversible toilet seat mounting structure, which does not produce pollutant. It is still another object of the present invention to provide an auto-reversible toilet seat mounting structure, which has a compact size and nice outer looking.

To achieve these and other objects of the present invention, the auto-reversible toilet seat mounting structure comprises a toilet seat, the toilet seat having pairs of plug holes disposed at a rear side thereof, and at least one pair of coupling devices selectively plugged into the pairs of plug holes and fastened pivotally with a bracket at the back side of a toilet bowl for enabling the toilet seat to be turned relative to the toilet bowl between a vertical position and a horizontal position and automatically returned to the vertical position after the toilet seat having been moved to the horizontal position and than released from pressure. Each coupling device comprises an inside holding space, a longitudinal partition wall longitudinally suspended in the inside holding space and obliquely downwardly extended from a rear side toward a front side and separating the inside holding space into an upper chamber and a lower chamber, a plurality of solid spherical members put in the inside holding space and movable between the upper chamber and the lower chamber, the solid spherical members each having a predetermined weight, first passage disposed at a rear side of the longitudinal partition wall between the upper chamber and the lower chamber, first door means pivoted to the first passage for enabling the steel balls to move from the lower chamber into the upper chamber and prohibiting the steel balls from passing through the first passage in direction from the upper chamber to the lower chamber, second passage disposed at a front side of the longitudinal partition wall between the upper chamber and the lower chamber, second door means adapted to close the second passage, and spring means supporting the second door means in the close position to close the second passage and adapted to open the second door means for enabling the steel balls to move through the second passage in one direct from the upper chamber to the lower chamber when compressed.

BRIEF DESCRIPTION OF THE DRAWINGS

FIG. 4A is a schematic drawing showing the coupling device turned from the vertical position to the horizontal position, the steel balls moved from the back side in the upper chamber to the front side in the upper chamber according to the present invention.

DETAILED DESCRIPTION OF THE PREFERRED EMBODIMENT

Figure 1A:
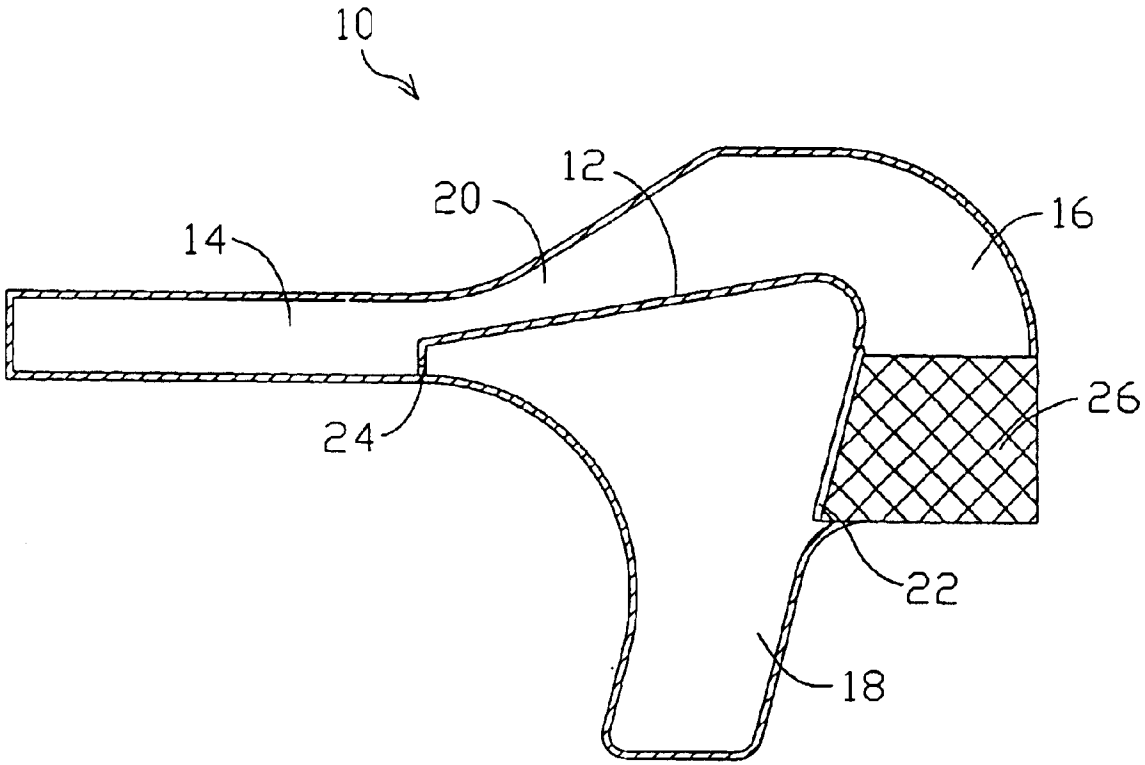
Fig. 1A (Prior Art)
FIG. 1A a sectional view of a coupling device for use in an auto-reversible toilet seat mounting structure according to the prior art.
Figure 1B:
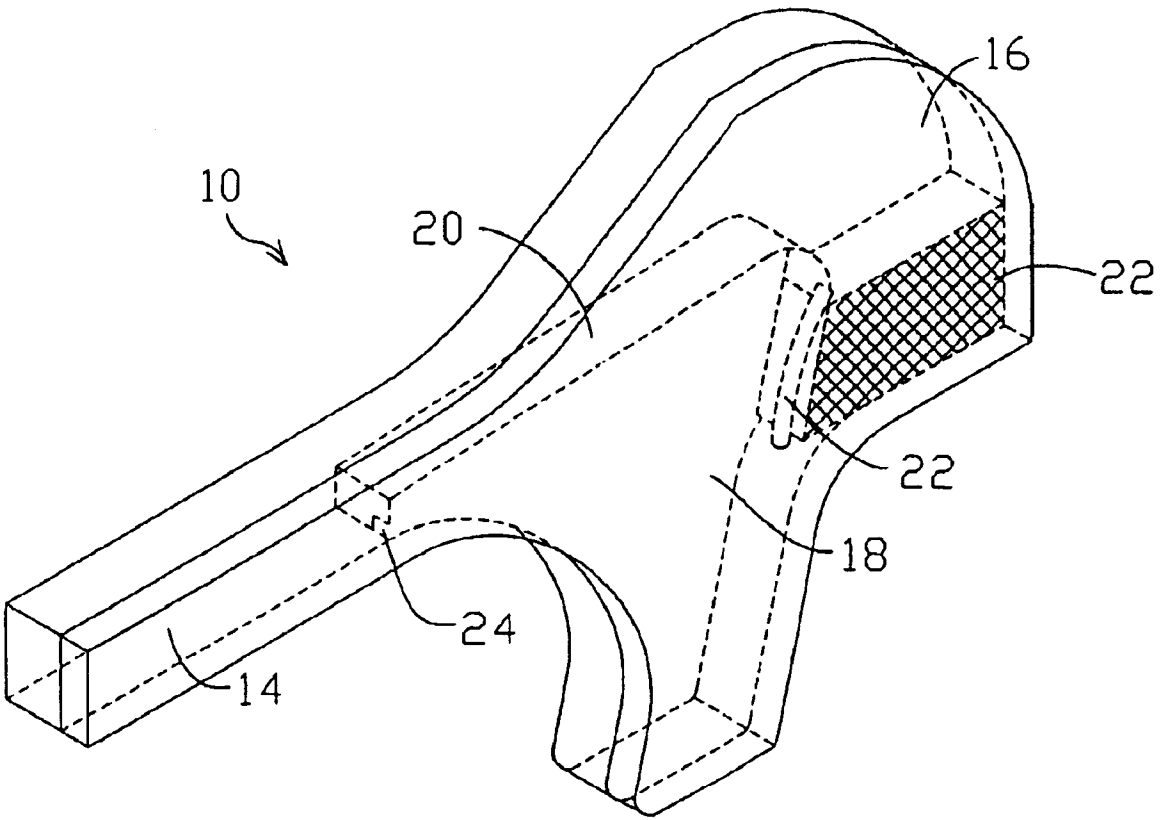
Fig.1B (Prior Art)
FIG. 1B is a perspective view of the coupling device shown in FIG. 1A.
Figure 2:
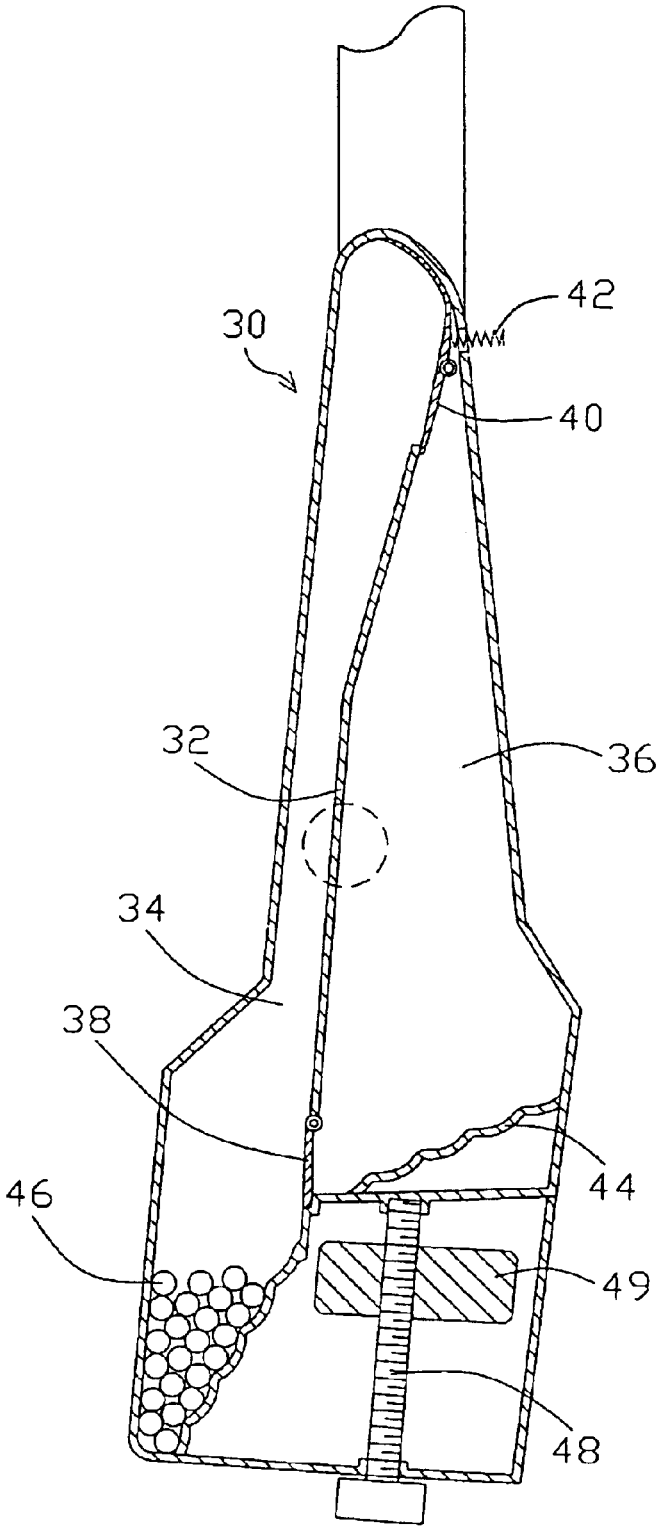
FIG. 2 is sectional view of a coupling device for use in an auto-reversible toilet seat mounting structure according to the present invention.

Referring to FIG. 2, a hollow coupling device 30 is shown comprising a corrugated partition plate 44 obliquely transversely suspended near the rear side, a smooth partition plate 32 longitudinally forwardly extended from a middle part of the corrugated partition plate 44 and obliquely extended to the front side, an upper chamber 34 and a lower chamber 36 separated by the smooth partition plate 32, a first swinging door 38 disposed at a rear side of the partition plate 32, a second swinging door 40 disposed at a front side of the partition plate 32, a spring member 42 provided at the bottom side of the second swinging door 40 to keep the second swinging door 40 in the close position when receiving no pressure and to force the second swinging door 40 to open the passage between the upper chamber 34 and the lower chamber 36 when receiving a pressure, a plurality of steel balls 46 put on the inside and movable between the upper chamber 34 and the lower chamber 35, an adjacent screw 48 provided at the rear side behind the corrugated partition plate 44, and a weight 49 mounted on the adjustment screw 48. The adjustment screw 48 can be rotated to move the weight 49 forwards or backwards inside the coupling device 30 and further adjust the center of gravity of the coupling device 30.

Figure 3:
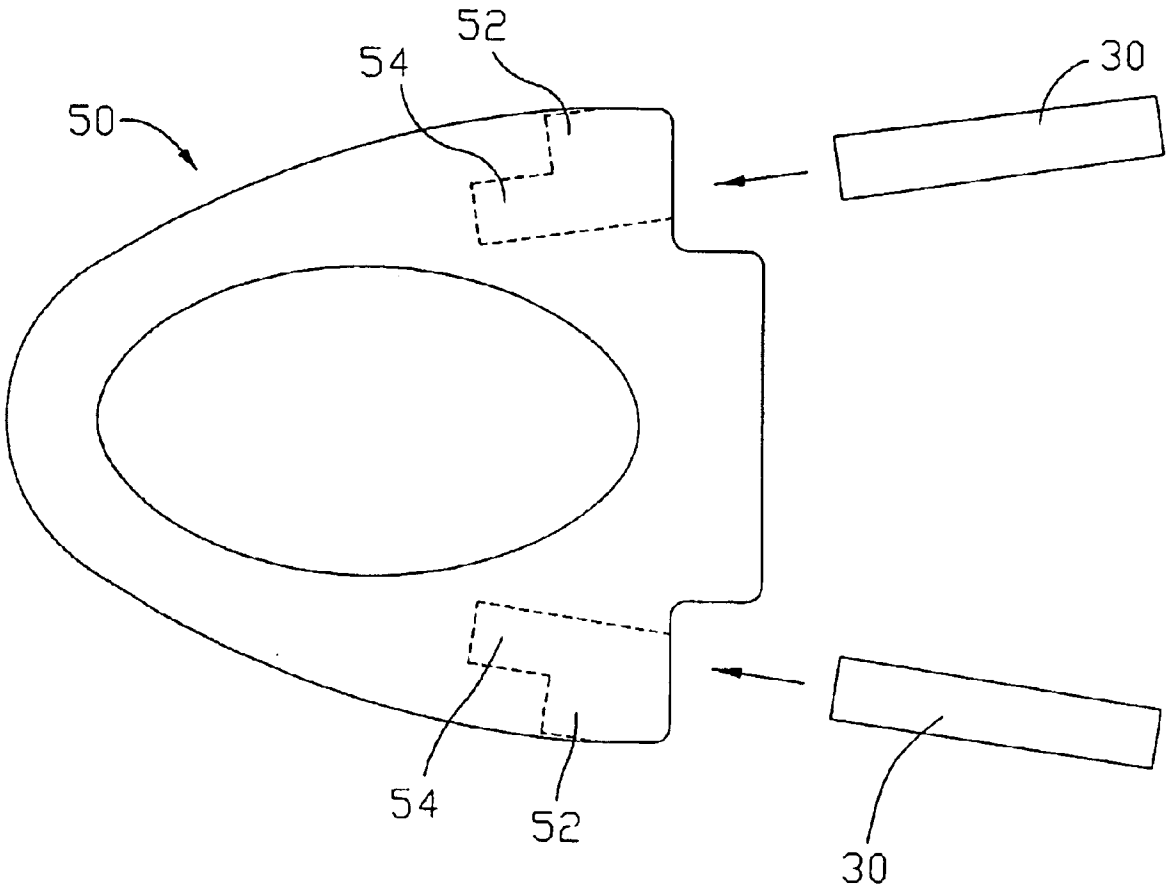
FIG. 3 is a schematic drawing showing the relationship between the toilet seat and the coupling devices according to the present invention.

Referring to FIG. 3, the toilet set lid 50 has two first plug holes 52 bilaterally disposed at the rear side, and two second plug holes 54 bilaterally disposed at the rear side and respectively disposed adjacent to the first plug holes 52 at an inner side. Two coupling devices 30 are selectively plugged into the first plug holes 52 or second plug holes 54 for pivotally fastening the toilet seat 50 to any of a variety of toilets (not shown). The first plug holes 52 may be respectively formed integral with the second plug holes 54.

Figure 4B:
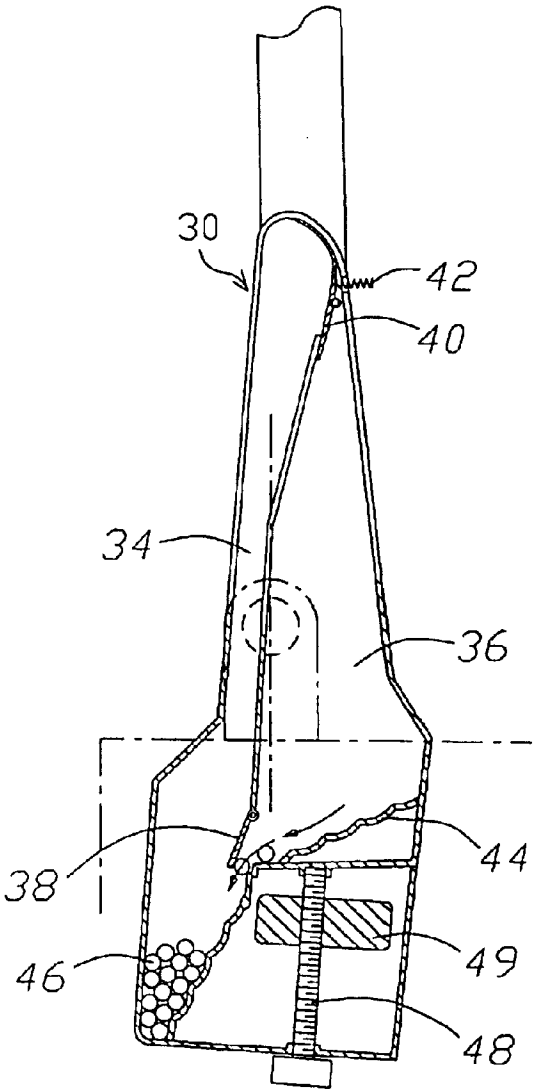
FIG. 4B is a schematic drawing showing the coupling device turned from the horizontal position to the vertical position, the steel balls circulated through the lower chamber.
Figure 4B:
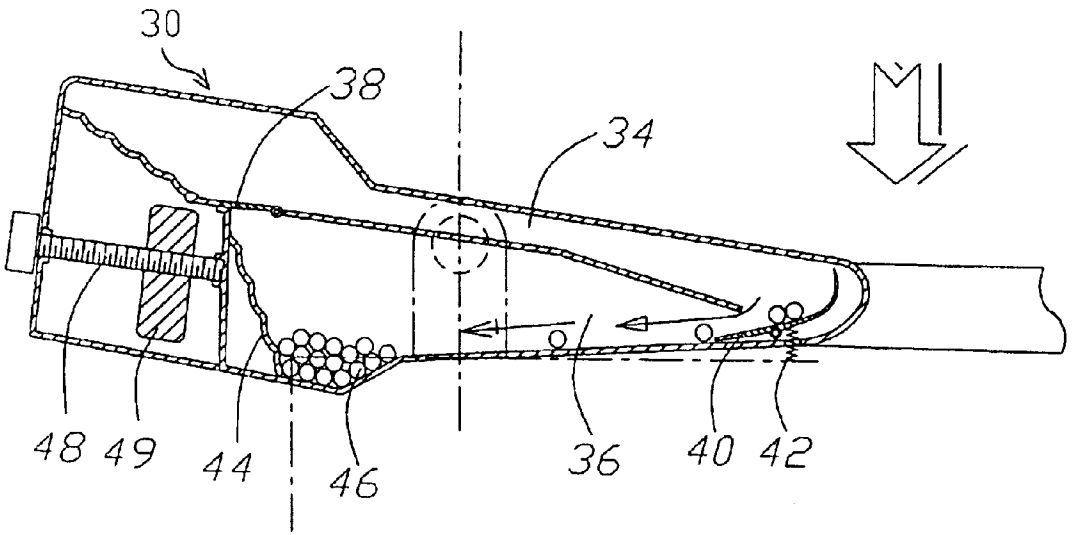

Referring to FIGS. 4A and 4B and FIGS. 2 and 3 again, when the user lowered the toilet seat 50 from the vertical position to the horizontal position to rest the toilet seat 50 on the toilet bowl (not shown), the steel balls 46 move along the closed first swinging door 38 and the top surface of the smooth partition plate 32 to the front side of each coupling device 30 and are gathered at the front side of the upper chamber 34 above the second swinging door 40 (see FIG. 4A). At this time, the spring member 42 receives no pressure, and the second swinging door 40 is closed to stop the steel balls 46 from passing through. When the user sitting on the toilet seat 50, the spring member 42 is forced against the toilet seat (not shown) to push open the second swinging door 40, for enabling the steel ball 46 to pass from the upper chamber 34 to the lower chamber 36 and then to be gathered at the bottom side of the corrugated partition plate 44 inside the lower chamber 36. After leaving of the user from the toilet seat 50, the respective steel balls 46 move along the obliquely extended corrugated partition plate 44 toward the first swinging door 38 to give a biasing force to the respective coupling device 30 (because the steel balls 46 are gathered at the rear side of the respective coupling device 30, which has a middle part fastened pivotally with a bracket at the back side of the toilet bowl and the toilet), thereby causing the respective coupling device 30 to be returned from the horizontal position toward the former vertical position. At this time, the steel balls 46 push open the first swinging door 38 and move from the lower chamber 36 into the upper chamber 34, and therefore the toilet seat 50 is returned to its former vertical position.

Figure 5:
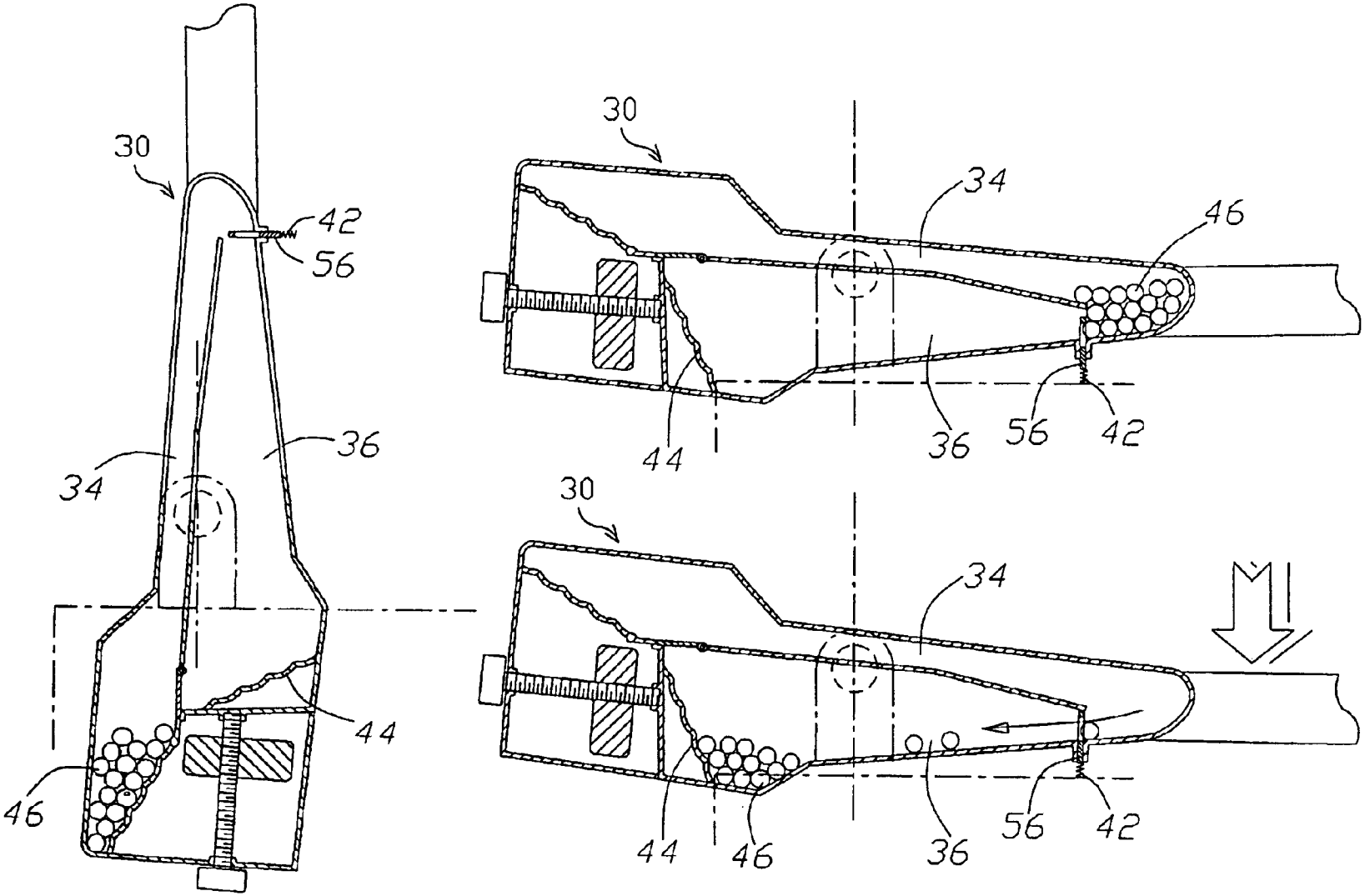
FIG. 5 is a schematic drawing showing the operation of an alternate form of the coupling device according to the present invention.

FIG. 5 shows an alternate form of the coupling device 30. According to this alternate form, a sliding eye plate 56 is used to substitute for the aforesaid second swinging door 40. The sliding eye plate 56 defines a through hole (not shown) having a diameter greater than the steel balls 46. When the spring member 42 receives no pressure, the sliding eye plate 56 is supported in a first position where a part of the through hole is blocked, and the steel balls 46 are prohibited from passing through. When the user sitting on the toilet seat lid to compress the spring member 42, the sliding eye plate 56 is moved from the first position to a second position where the through hole is fully opened for enabling the steel balls 46 to pass.

Figure 6:
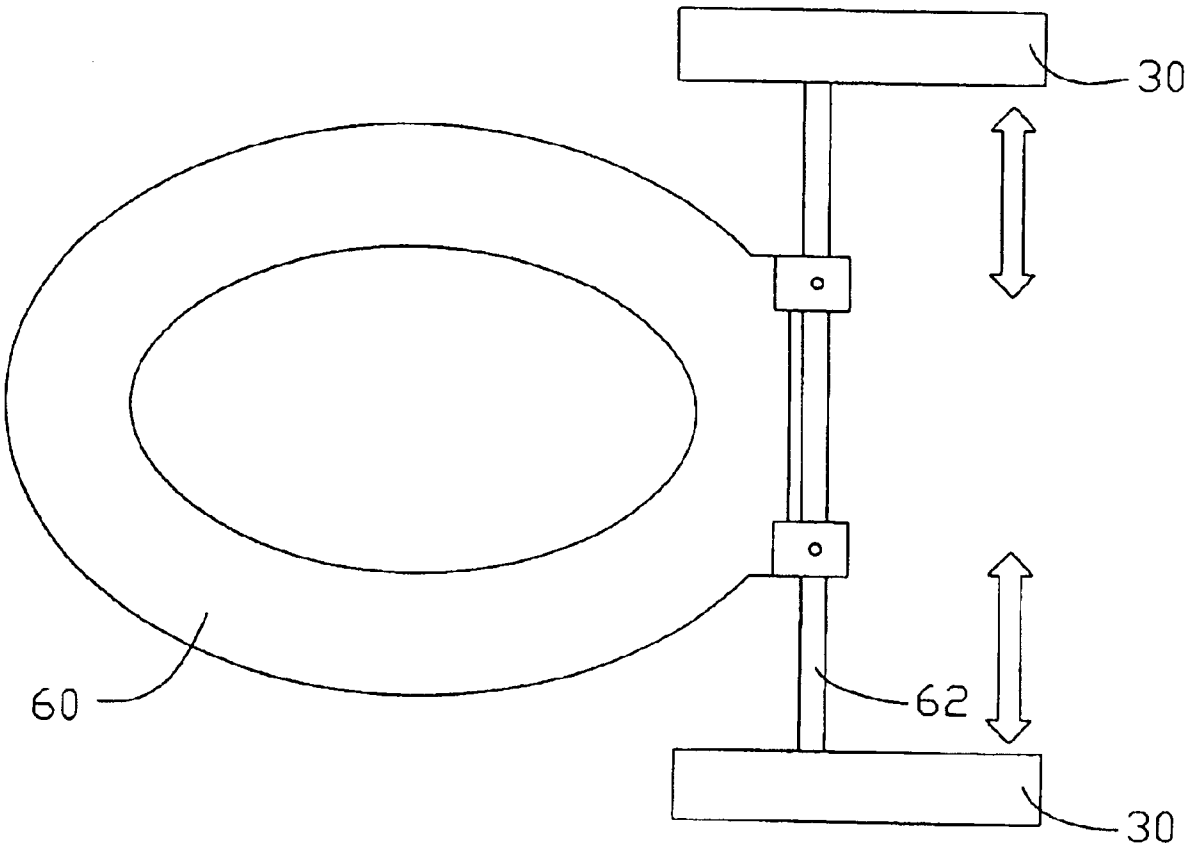
FIG. 6 shows another application example of the present invention.

FIG. 6 shows another application example of the present invention. As illustrated, the toilet seat 60 is fixedly fastened to a pivot shaft 62, and two coupling devices 30 are symmetrically mounted on the pivot shaft 62 near two ends. The pitch between the coupling devices 30 is adjustable to fit any of a variety of toilets.

Figure 7:
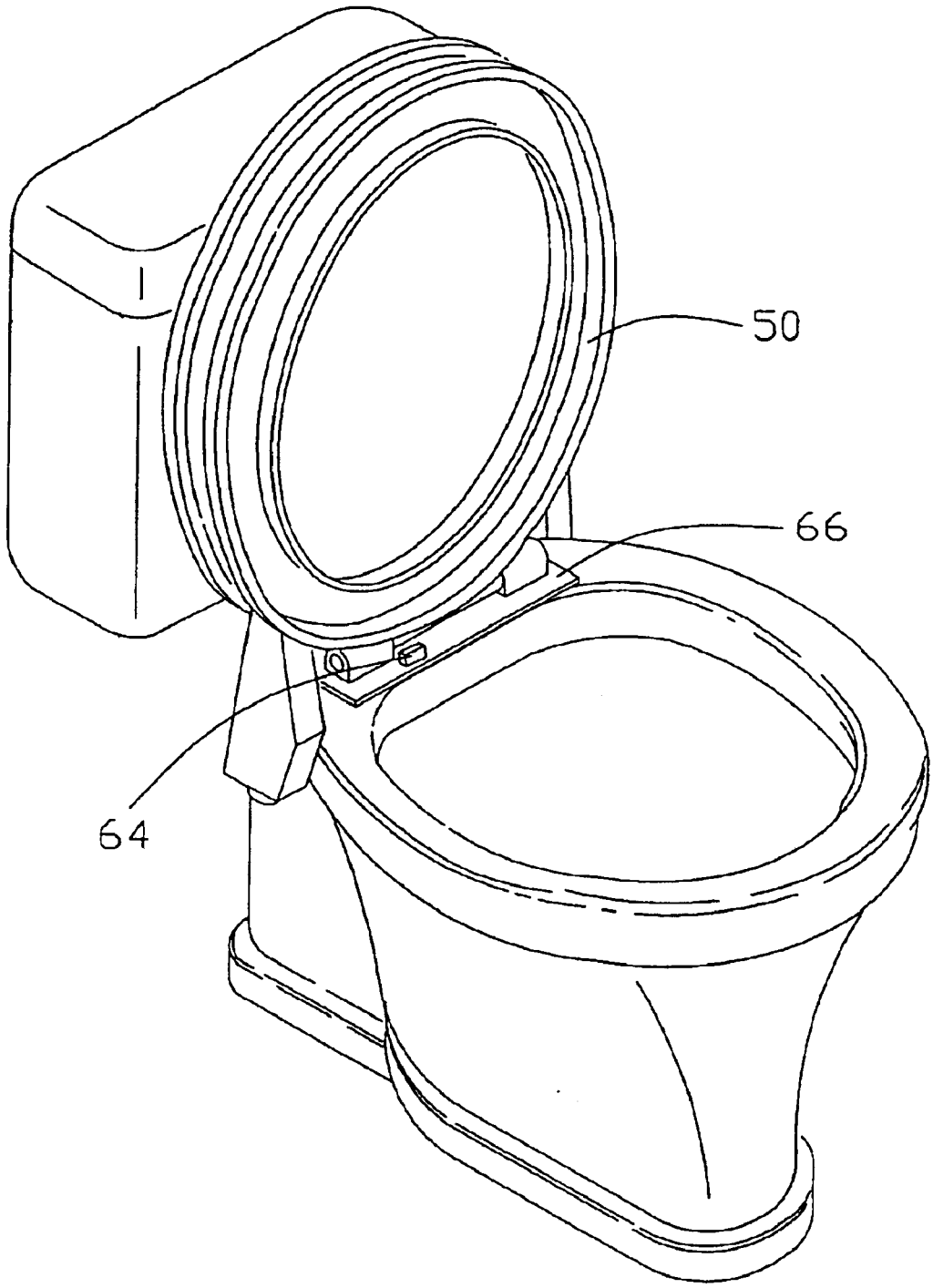
FIG. 7 is an elevational view of a toilet constructed according to the present invention, showing a micro switch installed at the bracket at the rear side of the toilet bowl adjacent to the toilet seat.

Referring to FIG. 7, the toilet seat 50 is pivoted to a bracket 66 at the back side of the toilet bowl above a micro switch 64. When user using the toilet and sitting on the toilet seat lid above the toilet seat 50, the toilet seat 50 is disposed in contact with the micro switch 64. After leaving of the user from the toilet seat lid, the toilet seat 50 is automatically lifted from the toilet bowl and the micro switch 64, at this time the micro switch 64 gives a signal to start the flushing system of the toilet and/or other electrically operated devices such as ozone generator, ultraviolet sterilizer, air purifier, etc.

As indicated above, the present invention provides an auto-reversible toilet seat mounting structure, which automatically smoothly lifts the toilet seat at a low speed only after each use of the toilet by a user.

A prototype of auto-reversible toilet scat mounting structure has been constructed with the features of FIGS. 2~7. The auto-reversible toilet seat mounting structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An auto-reversible toilet seat mounting structure comprising:

a toilet seat, said toilet seat having pairs of plug holes disposed at a rear side thereof; and at least one pair of coupling devices selectively plugged into said pairs of plug holes and fastened pivotally with a bracket at the back side of the toilet bowl of a toilet for enabling said toilet seat to be turned relative to said toilet bowl between a vertical position and a horizontal position and automatically returned to the vertical position after each use of the toilet by the user, each said coupling device comprising an inside holding space, a longitudinal partition wall longitudinally suspended in said inside holding space and obliquely downwardly extended from a rear side toward a front side and separating said inside holding space into an upper chamber and a lower chamber, a plurality of solid spherical members put in said inside holding space and movable between said upper chamber and said lower chamber, said solid spherical members each having a predetermined weight, first passage disposed at a rear side of said longitudinal partition wall between said upper chamber and said lower chamber, first door means pivoted to said first passage for enabling said steel balls to move from said lower chamber into said upper chamber and prohibiting said steel balls from passing through said first passage in direction from said upper chamber to said lower chamber, second passage disposed at a front side of said longitudinal partition wall between said upper chamber and said lower chamber, second door means adapted to close said second passage, and spring means supporting said second door means in the close position to close said second passage and adapted to open said second door means for enabling said steel balls to move through said second passage in one direct from said upper chamber to said lower chamber when compressed.

2. The auto-reversible toilet seat mounting structure as claimed in claim 1, wherein said first door means is a corrugated swinging door.

3. The auto-reversible toilet seat mounting structure as claimed in claim 1, further comprising a corrugated partition plate obliquely transversely disposed at a rear side of said lower chamber and extended from one side of said second passage and adapted to guide said steel balls from said lower chamber toward said second passage.

4. The auto-reversible toilet seat mounting structure as claimed 1, said second door means is an oblique swinging door.

5. The auto-reversible toilet seat mounting structure as claimed in claim 1, wherein said door means is a sliding door formed of an eye plate defining a circular through hole that has a diameter greater than the diameter of said solid spherical members.

6. The auto-reversible toilet seat mounting structure as claimed in claim 1, wherein said spring means is a coil spring.

7. The auto-reversible toilet seat mounting structure as claimed in claim 1, wherein said solid spherical members are steel balls.

8. The auto-reversible toilet seat mounting structure as claimed in claim 1, further comprising a micro switch adapted to control the operation of a flushing system upon each use of said toilet seat by a user.

9. The auto-reversible toilet seat mounting structure as claimed in claim 1, wherein each said coupling device further comprises a weight suspended inside said inside holding space near a rear side, and an adjustment screw adapted to move said weight in said inside holding space and to further adjust the center of gravity of the respective coupling device.

10. An auto-reversible toilet seat mounting structure comprising:

a pivot shaft;

a toilet seat fixedly fastened to said pivot shaft for synchronous rotation with said pivot shaft; and two coupling devices pivotally coupling said pivot shaft to a bracket at the rear side of the toilet bowl of a toilet for enabling said toilet seat to be turned with said pivot shaft and said coupling devices relative to said toilet bowl between a vertical position and a horizontal position and automatically returned to the vertical position after each use of the toilet by the user, each said coupling device comprising an inside holding space, a longitudinal partition wall longitudinally suspended in said inside holding space and obliquely downwardly extended from a rear side toward a front side and separating said inside holding space into an upper chamber and a lower chamber, a plurality of solid spherical members put in said inside holding space and movable between said upper chamber and said lower chamber, said solid spherical members each having a predetermined weight, first passage disposed at a rear side of said longitudinal partition wall between said upper chamber and said lower chamber, first door means pivoted to said first passage for enabling said steel balls to move from said lower chamber into said upper chamber and prohibiting said steel balls from passing through said first passage in direction from said upper chamber to said lower chamber, second passage disposed at a front side of said longitudinal partition wall between said upper chamber and said lower chamber, second door means adapted to close said second passage, and spring means supporting said second door means in the close position to close said second passage and adapted to open said second door means for enabling said steel balls to move through said second passage in one direct from said upper chamber to said lower chamber when compressed.

11. The auto-reversible toilet seat mounting structure as claimed in claim 10, wherein said first door means is a corrugated swinging door.

12. The auto-reversible toilet seat mounting structure as claimed in claim 10, further comprising a corrugated partition plate obliquely transversely disposed at a rear side of said lower chamber and extended from one side of said second passage and adapted to guide said steel balls from said lower chamber toward said second passage.

13. The auto-reversible toilet seat mounting structure as claimed 10, said second door means is an oblique swinging door.

14. The auto-reversible toilet seat mounting structure as claimed in claim 10, wherein said door means is a sliding door formed of an eye plate defining a circular through hole that has a diameter greater than the diameter of said solid spherical members.

15. The auto-reversible toilet seat mounting structure as claimed in claim 10, wherein said spring means is a coil spring.

16. The auto-reversible toilet seat mounting structure as claimed in claim 10, wherein said solid spherical members are steel balls.

17. The auto-reversible toilet seat mounting structure as claimed in claim 10, further comprising a micro switch adapted to control the operation of a flushing system upon each use of said toilet seat by a user.

18. The auto-reversible toilet seat mounting structure as claimed in claim 10, wherein each said coupling device further comprises a weight suspended inside said inside holding space near a rear side, and an adjustment screw adapted to move said weight in said inside holding space and to further adjust the center of gravity of the respective coupling device.

* * * * *